United States Patent [19]

Kinoshita

[11] Patent Number: 4,688,352

[45] Date of Patent: Aug. 25, 1987

[54] AUTOMATIC DOOR FOR A REFRIGERATOR

[76] Inventor: Nichio Kinoshita, 2-25, Jyoto 4-chome, Kohfu City, Yamanashi Prefecture, Japan

[21] Appl. No.: 715,472

[22] Filed: Mar. 25, 1985

[30] Foreign Application Priority Data

Mar. 26, 1984 [JP] Japan ..... 59-41863[U]

[51] Int. Cl.[4] ..... E05D 15/10

[52] U.S. Cl. ..... 49/209; 49/221

[58] Field of Search ..... 49/209, 221

[56] References Cited

U.S. PATENT DOCUMENTS

| | | | |
|---|---|---|---|
| 1,031,258 | 7/1912 | Haley | 49/221 |
| 1,092,617 | 4/1914 | Wiley | 49/221 X |
| 2,157,678 | 5/1939 | Schielke | 49/221 X |
| 3,500,584 | 3/1970 | Clery et al. | 49/209 |
| 3,660,936 | 5/1972 | Bryson | 49/209 |
| 3,886,685 | 6/1975 | Riphagen | 49/209 |

FOREIGN PATENT DOCUMENTS

| | | | |
|---|---|---|---|
| 1523350 | 8/1978 | United Kingdom | 49/209 |
| 1533222 | 11/1978 | United Kingdom | 49/209 |

*Primary Examiner*—Philip C. Kannan

*Attorney, Agent, or Firm*—Amster, Rothstein & Ebenstein

[57] ABSTRACT

An automatic door for large-sized refrigerators, etc. is comprised of a door panel slidably supported by a stationary horizontal guide rail, a double-acting horizontal piston-cylinder unit for sliding the door panel along the guide rail for opening or closing the front opening of the refrigerator, and tightening units for tightening the door panel against a refrigerator panel when the door panel is in the closure position. The double-acting piston-cylinder unit is freed of pressure when the door panel is in the closure position so that the door panel is maintained in the latter position solely by the tightening pressure of the tightening units this pressure selected so as to be sufficiently small enough to be overcome by manual pressure if the need arises and yet still maintain the door panel in a hermetically sealed position against the refrigerator panel.

6 Claims, 3 Drawing Figures

2
22
4
29
12
21
25
23
14
26
18
19
10
11
24
27
15
1
3

AUTOMATIC DOOR FOR A REFRIGERATOR

BACKGROUND OF THE INVENTION

This invention relates to an automatic door apparatus of the type operated by fluid pressure such as hydraulic or pneumatic pressure for opening or hermetically closing rooms or containers such as refrigerators, freezers, clean rooms or for depositories subject to radio wave noise, expecially large-sized commercial refrigerators or freezers.

In large-sized refrigerator or freezers, it is known to use electrically driven sliding doors adapted to slide along the side of the refrigerator panel for exposing or closing the front opening or aperture. The door is driven by an electric motor through a guide chain along a guide rail placed on the floor or along the upper edge of the front aperture and, when in the closed position, the door is tightly pressed against the refrigerator panel by means of suitable tightening units. The guide chains for electrically driven doors of large-sized refrigerators are heavy to move and noisy during operation. Also such door systems are expensive and complicated in structure. Further, since these doors are fully automatic in operation, a worker may be accidentally shut inside the refrigerator by the inadvertent operation or malfunction of the driving system.

SUMMARY OF THE INVENTION

It is therefore an object of the present invention to overcome these difficulties of the prior art and to provide an automatic door apparatus according to which a doubleacting piston-cylinder unit adapted for sliding the door panel suspended by a horizontal guide rail is provided, said unit being relieved of pressure when the door panel driven thereby is in a position closing the opening, said door panel being pressed when in such a position against the refrigerator panel by tightening units at several positions, such as at the four corners of the door panel, in such a manner that the door panel can be opened manually in case of an emergency.

Broadly, the present invention resides in an automatic door apparatus for a refrigerator comprising:

a door panel;

a horizontal guide rail securely mounted to a refrigerator panel and extending substantially parallel to the upper edge of an opening in said refrigerator panel;

a horizontal double-acting piston-cylinder unit for sliding said door panel along said guide rail between a first position in which said opening is closed by said door panel and a second position in which said opening is completely exposed; and means for pressing the door panel against the refrigerator panel at a plurality of positions when in said first position so as to hermetically close said opening by said door panel.

Other features, objects or advantages of the present invention will become more apparent from perusal of the following detailed description especially in conjunction with the accompanying drawings.

DESCRIPTION OF A PREFERRED EMBODIMENT

Figures 1, 2:
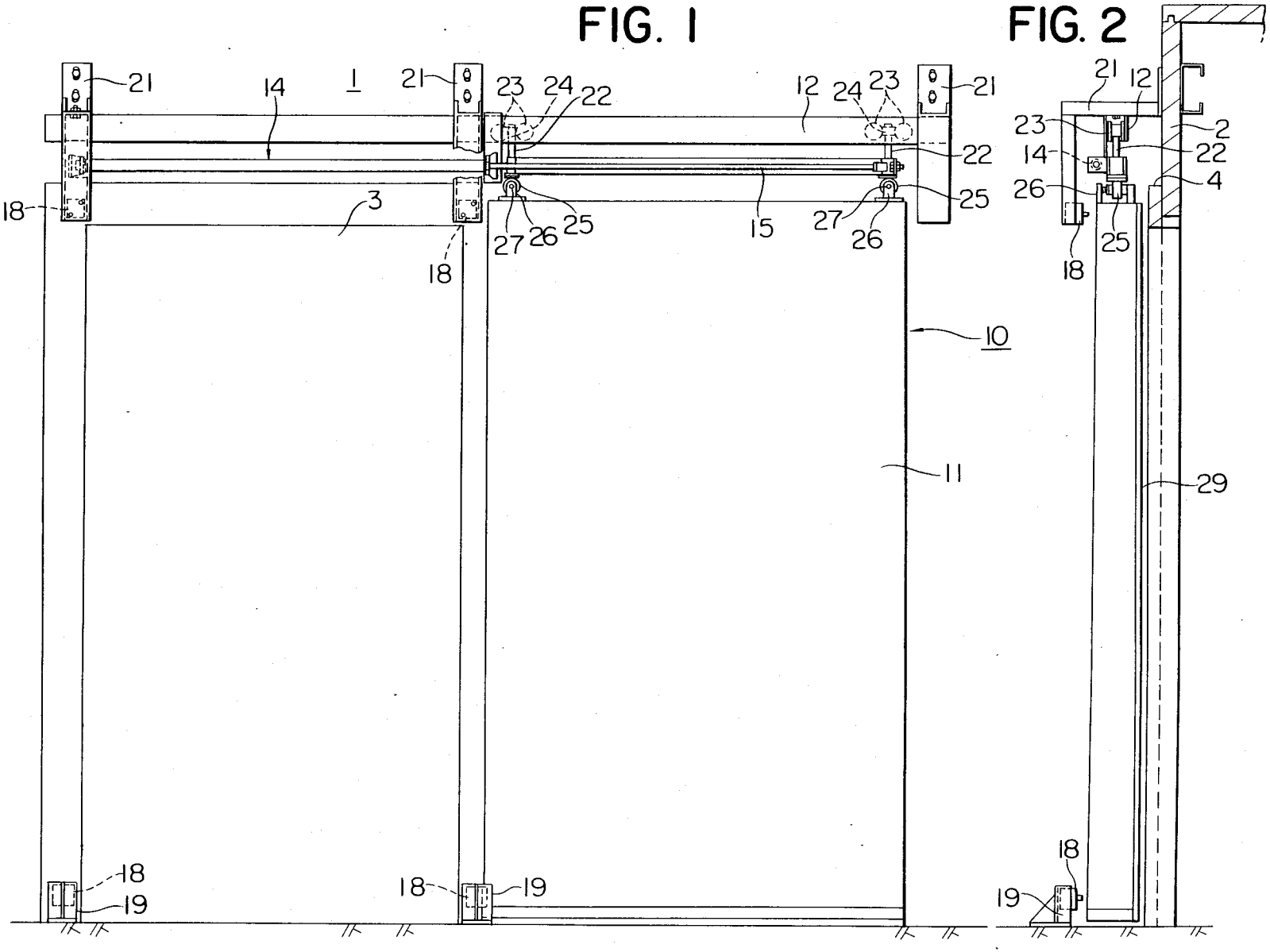
FIG. 1 is a front view of the automatic door apparatus according to the present invention.
FIG. 2 is a side elevation of the apparatus shown in FIG. 1.

As shown in FIGS. 1 and 2 of the accompanying drawings, an automatic door apparatus 10 of the present invention is used in conjunction with a conventionally constructed refrigerator 1 for the freezing or cold storage of various item. The door apparatus is comprized of a door panel 11, a double-acting piston-cylinder unit 14 and a plurality of tightening units 18. The door panel 11 is suspended from and carried by a horizontal guide rail 12 extending substantially parallel to the upper edge of a front opening 3 of a refrigerator panel 2 as later described and may be slid along the guide rail 12 by the operation of the piston-cylinder unit 14. The tightening units 18 are adapted to press and tighten the door panel 11 against the refrigerator panel 2 at a number of positions, preferably at the four corners, when the door panel is in a position closing the front opening 3.

The front opening is formed in the refrigerator panel 2 to the required size and fitted with a framing member 4.

Figure 3:
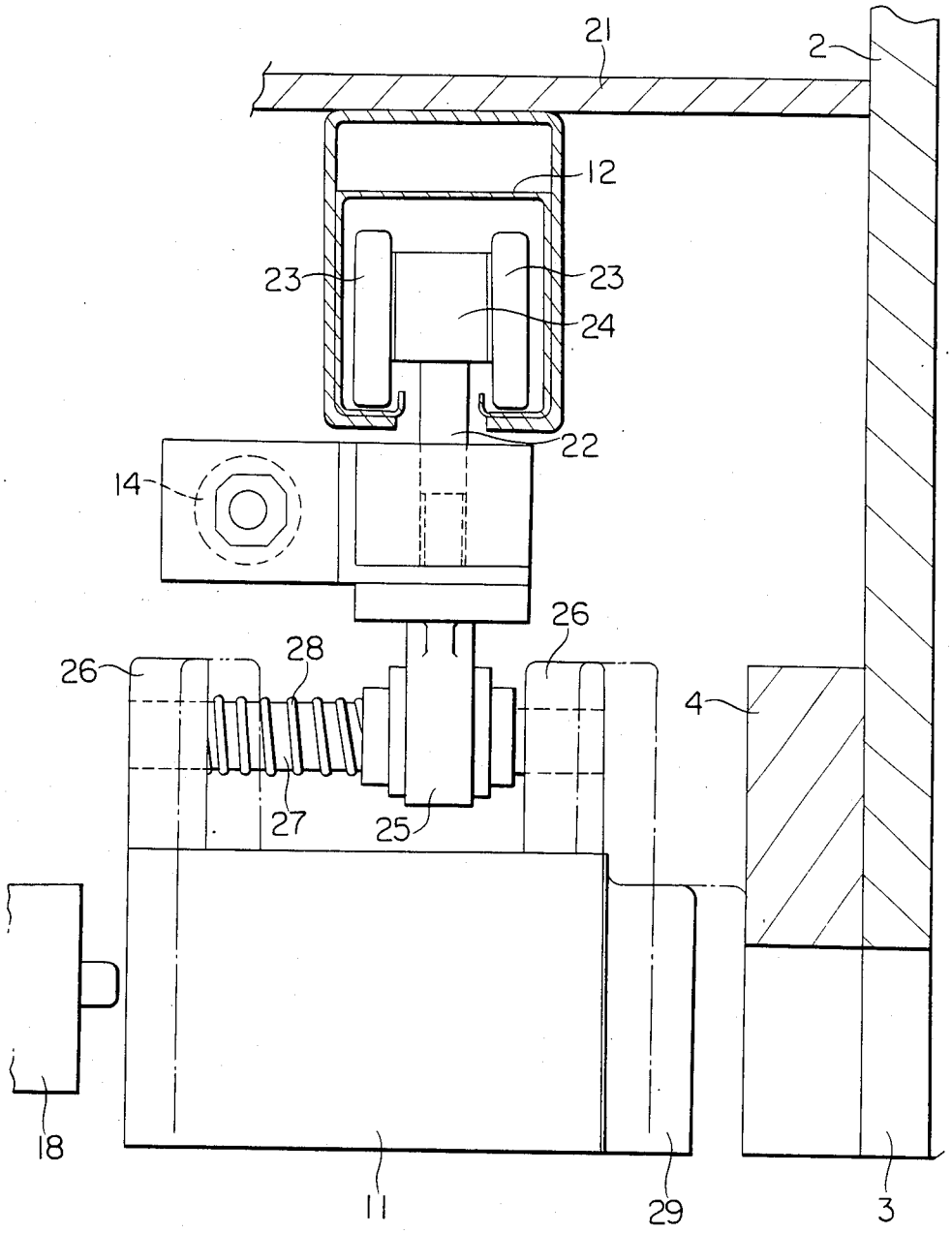
FIG. 3 is an enlarged partial side elevation, partially shown in section and showing the detailed structure of the door panel supporting portion.

The door panel 11 of the automatic door apparatus 10 adapted for opening and closing the front opening 3 of the refrigerator 1 is suspended and carried by a pair of hangers 22 spaced apart slightly above the upper edge of the opening 3 so as to slide along the horizontal guide rail 12 supported by a number of L-shaped brackets 21 secured in turn to some fixed portion of the refrigerator 1. As shown in FIG. 3, the upper end of the hanger 22 is connected to a supporting element 24 associated with a pair of rollers 23 slidable along the guide rail 12. The lower end of the hanger 22 is connected by a slide bearing unit 25 and a slide pin 27 to a pair of supporting members 26 secured to the upper end face of the door panel 11. The distal end of a piston rod 15 of the double-acting piston-cylinder unit 14 is connected to the right side hanger 22 when seen in FIG. 1. Preferably, the piston-cylinder unit 14 is a long stroke double-acting pneumatic cylinder unit supported at the cylinder part thereof by the brackets 21 secured in turn to some fixed portion of the refrigerator 1 by suitable fasteners, not shown.

The back side of the door panel 11 facing towards the front opening 3 is fitted with a packing 29 for maintaining a hermetic seal when the door panel 11 is in the position of closing the opening 3. Tightening units 18 are provided at the four corners of the door panel 11 for pressing the door panel 11 against the opening 3 when the door panel is in the closing position. The upper two tightening units 18 are securely fitted to the depending legs of the L-shaped supporting brackets 21 of the guide rail 12, while the remaining two units 18 are securely supported by supporting brackets 19 as shown, these brackets 19 being securely mounted on the floor. It is preferable that these tightening unit 18 are also pneumatic piston cylinder type units and designed in such manner that the four corners of the door panel 11 are pressed against the refrigerator panel 2 by the piston part of the pneumatic piston cylinder units under the action of the air supplied under pressure to the piston cylinder units. Since the slide pin 27 securely supported by the supporting members 26 securely fitted in turn to the upper edge surface of the door panel 11 are slidable within the associated slide bearing unit 25 secured to the lower end of the hanger 22, the door panel 11 can be moved towards the refrigerator panel 2 when pressed by the tightening units. A return spring 28 is provided to the slide pin 27 in such a manner that the door panel 11 is pushed back away from the refrigerator panel 2 under the effect of the spring 28 when the pressure applied by the tightening units 18 is removed.

In operation, when the opening 3 is exposed as shown in FIG. 1, the piston cylinder unit 14 can be energized by the air under pressure in a direction of retracting the piston rod 15 into the cylinder, so that the door panel 11 is pulled towards the left as viewed in FIG. 1, through means of the right side hanger 22 securely connected to the piston rod 15, with the rollers 23 then rolling along the guide rail 12. When the door panel 11 has reached the position of closing the front opening 3 of the refrigerator 1, the supply of pressurized air into the piston cylinder unit 14 is descontinued and the inside of the unit is relieved of pneumatic pressure for free communication with the ambient air. Then the four pneumatic piston cylinder units 18 placed at the four corners of the door panel 11 are supplied with pressurized air whereby the door panel 11 is pressed against the refrigerator panel 2 through means of the piston part of the piston cylinder units for a firm units hermetical closing of the opening 3 of the refrigerator 1. Only a small pressure exerted by the tightening units 18 is needed to maintain a complete hermetic seal of the front opening 3. Should a person be inadvertently shut inside the refrigerator, that person may push the door panel forward from inside the refrigerator while simultaneously sliding the panel 11 transversely on the rail. In this manner, the door panel 11 can be easily opened because the inside of the piston cylinder unit 14 is no longer under pneumatic pressure. In addition, the opening or closure of the door panel 11 may be effected easily and smoothly by the operation of the double-acting type piston-cylinder unit 14. The automatic door can also be of compact and simple construction while the power costs are also lowered through use of an air compressor.

What is claimed is:

1. An automatic door apparatus for a refrigerator comprising:

a door panel having an upper end;

a refrigerator panel forming at least a portion of the exterior of the refrigerator, the refrigerator panel having an opening with an upper edge, the opening permitting access to the interior of the refrigerator;

a horizontal guide rail securely mounted relative to the refrigerator panel and positioned above the upper edge of the opening of the refrigerator panel;

means for slidably suspending and supporting the door panel from the guide rail including at least one roller slidable along the guide rail, a hanger member having an upper end and a lower end, a supporting element associated with the roller and connected proximate to the upper end of the hanger member, bearing means for coupling the upper end of the door panel to the lower end of the hanger member and constructed to permit movement of the door panel in a direction perpendicular to the guide rail, said bearing means including a slide bearing unit, a slide pin coupled to and movable with respect to the slide bearing unit within preset limits and a pair of supporting elements secured proximate to the upper edge of the door panel and receiving the opposite ends of the slide pin to couple the door panel to the hanger member;

a horizontal double-acting piston cylinder unit including a piston rod coupled to the hanger member for moving the door panel along the guide rail between a first position at which the opening can be closed by the door panel and a second postion which permits access to the interior of the refrigerator through the opening; and means for moving the door panel perpendicular to the guide rail when the door panel is in the first position to hermetically seal the opening.

2. The automatic door apparatus according to claim 1 wherein the horizontal guide rail is mounted to the refrigerator panel by a plurality of L-shaped brackets that are supported and spaced at positions along the upper edge of the refrigerator panel.

3. The automatic door apparatus according to claim 1 wherein the means for moving the door panel perpendicular to the guide rail includes at least two pneumatic piston cylinder units positioned adjacent the door panel to impart movement to the door panel in a direction perpendicular to the guide rail.

4. The automatic door apparatus according to claim 3 wherein the pressure exerted by the pneumatic piston-cylinder unit to hermetically seal the opening is less than a manual force required to be exerted in a direction opposite to the force to manually open said door.

5. The automatic door apparatus according to claim 1 wherein the piston rod of the horizontal double-acting piston cylinder unit includes a distal end that is fixed to the hanger member of the suspending and supporting means.

6. The automatic door apparatus according to claim 5 wherein the piston rod of the horizontal double-acting piston cylinder unit is relieved of penumatic pressures for free communication with the ambient air once the door panel is engaged in the first position.

* * * * *